United States Patent [19]

Thiruvarudchelvan

[11] 4,300,378

[45] Nov. 17, 1981

[54] METHOD AND APPARATUS FOR FORMING ELONGATED ARTICLES HAVING REDUCED DIAMETER CROSS-SECTIONS

[76] Inventor: Sinnathamby Thiruvarudchelvan, 45 Hardy Dr., St. Augustine, Trinidad and Tobago

[21] Appl. No.: 18,836

[22] Filed: Mar. 8, 1979

[51] Int. Cl.[3] ..... B21C 23/08; B21C 23/20; B21C 25/02; B21C 27/00

[52] U.S. Cl. ..... 72/253.1; 72/256; 72/264; 72/64; 72/65; 72/274; 72/278; 72/68

[58] Field of Search ..... 72/77, 68, 274, 278, 72/285, 253, 256, 264, 64, 65; 264/310; 425/376 R, 376 B

[56] References Cited

U.S. PATENT DOCUMENTS

| | | | |
|---|---|---|---|
| 411,060 | 9/1889 | Robertson | 72/77 |
| 444,721 | 1/1891 | Bevington | 72/112 X |
| 1,945,877 | 2/1934 | Bonte | 72/278 X |
| 2,313,474 | 3/1943 | Hill | 72/77 X |
| 2,596,552 | 5/1952 | Heimann | 29/33 D |
| 3,158,258 | 11/1964 | Kelday et al. | 72/77 X |
| 3,279,230 | 10/1966 | Johnson | 72/263 X |
| 3,470,720 | 10/1969 | Eklund et al. | 72/112 X |
| 3,824,825 | 7/1974 | Green | 72/60 |
| 4,053,274 | 10/1977 | Lemelson | 264/310 X |

FOREIGN PATENT DOCUMENTS

| | | | |
|---|---|---|---|
| 1394404 | 5/1975 | United Kingdom | 72/68 |
| 590030 | 1/1978 | U.S.S.R. | 72/77 |

*Primary Examiner*—Lowell A. Larson
*Attorney, Agent, or Firm*—Steinberg & Raskin

[57] ABSTRACT

A method and apparatus for forming elongated articles whereby a torque is transmitted to the deforming material as it passes through a die cavity to facilitate the reduction in the cross-section thereof as it passes therethrough. In one embodiment, the apparatus includes a rotatable die member having a longitudinally extending die cavity, the end region thereof having a reduced diameter circular cross-section. A cavity region upstream of the downstream end region has a non-circular cross-section. Means are provided for positively rotating the die member about its longitudinal axis. In the corresponding embodiment of the method of the present invention, the material from which the article is formed is drawn under tension or compression through the die cavity while the die member is positively rotated so as to impart a torque to the material passing through the cavity which produces shear stresses within the material which facilitates a reduction in the circular cross-section as the material moves through the die cavity.

25 Claims, 23 Drawing Figures

FIG. 9
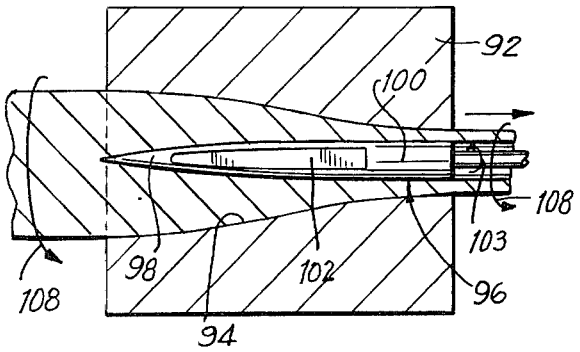
FIG. 10
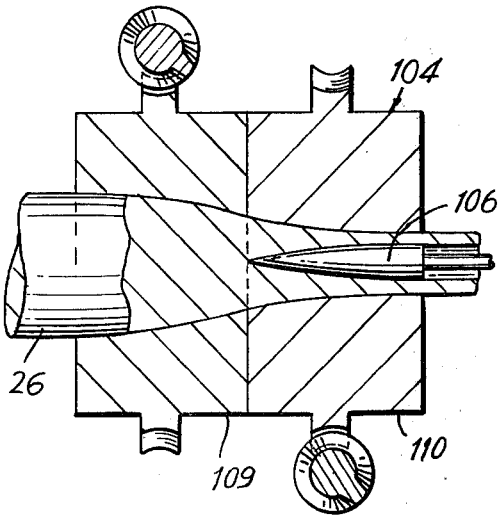
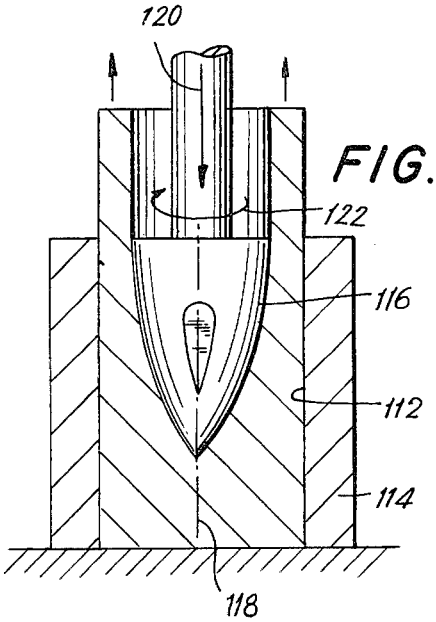
FIG. 11
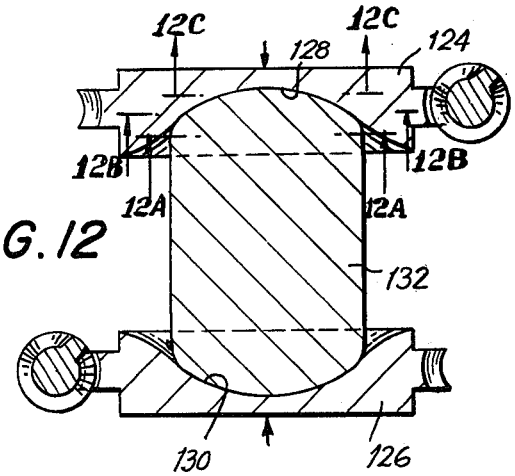
FIG. 12
FIG. 13
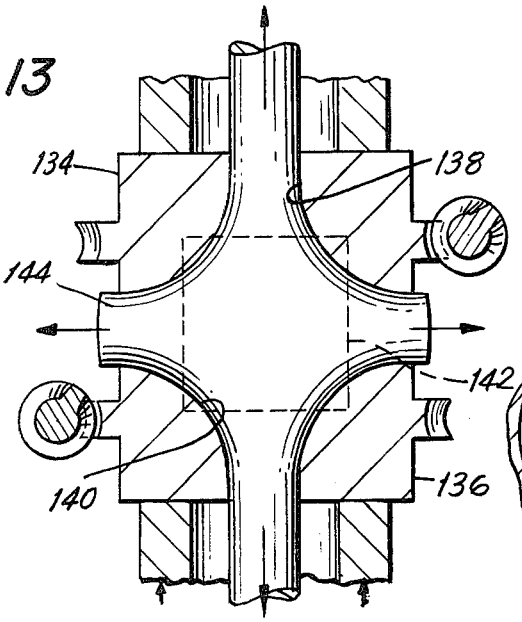
FIG. 12A
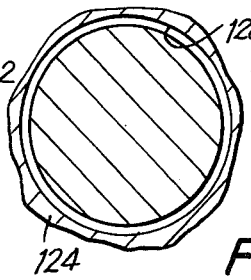
FIG. 12C
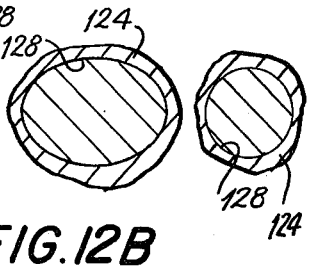
FIG. 12B

METHOD AND APPARATUS FOR FORMING ELONGATED ARTICLES HAVING REDUCED DIAMETER CROSS-SECTIONS

BACKGROUND OF THE INVENTION

This invention relates generally to methods and apparatus for forming articles and, more particularly, to a method and apparatus for forming elongated articles having reduced diameter circular cross-sections.

Generally, in the formation of elongate metallic articles having circular cross-sections, the metallic material is compressed above its elastic limit in a chamber and is forced to flow through and take on the shape of a circular opening defined by a die cavity. Such processes are generally termed extrusion, where the material is forced under compression through the die cavity, or drawing, wherein the material is pulled under tension through the cavity. The term "extrusion" will be used hereinafter to refer generally to such processes wherein the material takes on the form of a die cavity. Thus, other material forming processes, such as forging, will be within the scope of this term. Such processes can be used in the production of solid cylindrical extrusions, such as wire, or tubular extrusions, the latter of which are provided by the location of an elongate ram or mandrel in the die cavity.

In present extrusion processes, the work required to be done on the material to deform the same is supplied through either the tensile or compressive forces which are provided during the movement of the metal through the die cavity. However, since the extent of the metal deforming work done by the above-mentioned tensile and compressive forces is, by necessity, limited, the amount of reduction of the circular cross-section of the material is correspondingly limited. Thus, it is frequently necessary to utilize several successive dies in order to obtain an elongate article having a reduced-diameter circular cross-section.

SUMMARY OF THE INVENTION

Accordingly, one object of the present invention is to provide a new and improved method and apparatus for forming metallic articles.

Another object of the present invention is to provide a new and improved method and apparatus for forming elongated metallic articles having reduced diameter circular cross-sections.

Still another object of the present invention is to provide a new and improved method and apparatus wherein the diameter of the article being formed can be reduced to a greater extent than with prior methods and apparatus.

Briefly, in accordance with the present invention, these and other objects are attained by providing a method and apparatus wherein a torque is imparted to the material as it passes longitudinally within a die cavity. The shear stresses set up in the material as a result of the torsion facilitates the deformation of the material within the die, i.e., the shear stresses supplement the tensile or compressive forces on the material which traditionally exist in extrusion processes. In one embodiment of the invention, a rotatably mounted die member defines a cavity having a downstream end region having a circular cross-section and a region upstream therefrom which has a non-circular cross-section. As the material is forced through the die cavity, the die member is positively rotated whereby a rotational torque is transmitted by the die member to the material. A rotation resisting torque is applied to the material through other means, such as through a second die member, also having a region having a non-circular cross-section defined by its die cavity, which second die member is maintained stationary. In this manner, shear stresses are set up in the material as the same passes through the die cavity thereby facilitating the deformation or reduction in the diameter of the circular cross-section of the produced article. In other words, it is now possible to obtain an article having a larger reduction in diameter than was possible using comparable prior techniques to thereby increase productivity in the manufacture of rods, tubes, wire, etc. Other embodiments of the invention include methods and apparatus wherein a mandrel is located within the die cavity to form a tubular article. In such cases, the mandrel has an axial portion of non-circular cross-section. The mandrel or die is rotated about its longitudinal axis to impart a torque to the material as it passes through the die cavity. A resisting torque is supplied by the other of the die or mandrel, which does not rotate. Additionally, forging methods and apparatus are disclosed which utilize the principles of the present invention.

DESCRIPTION OF THE DRAWINGS

A more complete appreciation of the invention and many of the attendant advantages thereof will be readily appreciated as the same becomes understood by reference to the following detailed description when considered in connection with the accompanying drawings in which:

FIG. 9 is a schematic view in section of another embodiment of the tube forming apparatus and method illustrated in FIG. 8;

FIG. 10 is yet another embodiment of a tube forming apparatus and method according to the present invention;

FIG. 11 is a schematic sectional view of a method and apparatus according to the present invention for making tubes;

FIG. 12 is a schematic view of a forging method and apparatus according to the present invention;

FIGS. 12A–12C are section views taken along lines a—a, b—b and c—c of FIG. 12;

FIG. 13 is another embodiment of a forging method and apparatus according to the present invention.

DESCRIPTION OF PREFERRED EMBODIMENTS

Figure 1:
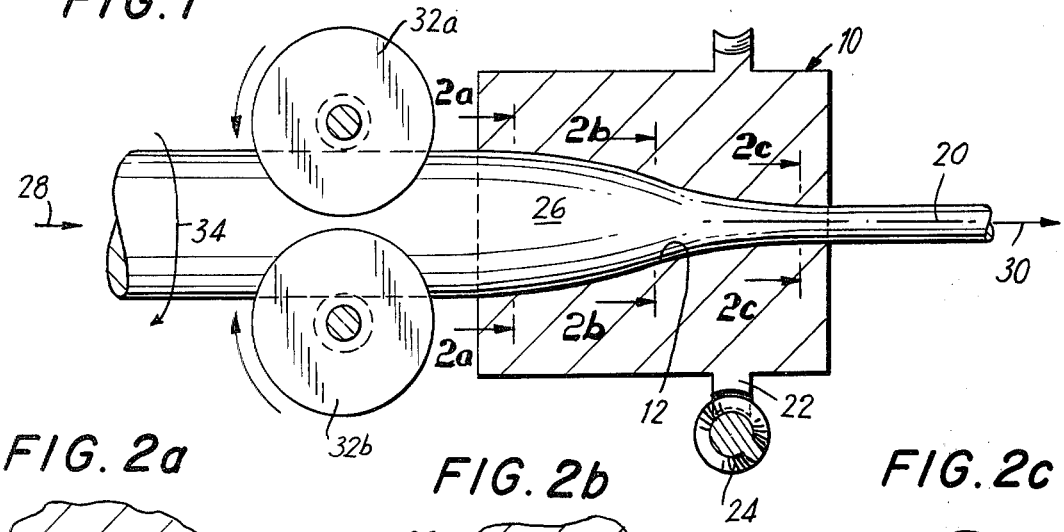
FIG. 1 is a schematic view of an apparatus according to the present invention illustrating the method of the invention.
Figure 2A:
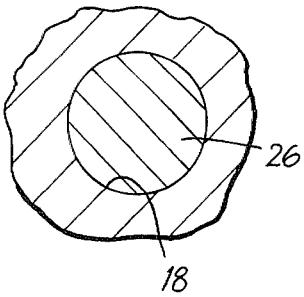
FIGS. 2*a*–2*c* are section views taken along lines 2*a*—2*a*, 2*b*—2*b*, and 2*c*—2*c* of FIG. 1.
Figure 2B:
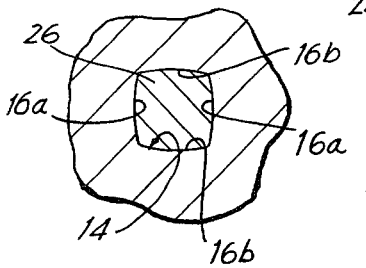
Figure 2C:
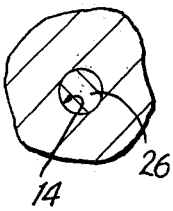

Referring now to the drawings where like reference characters designate identical or corresponding parts throughout the several views, and more particularly to FIGS. 1 and 2 thereof, one embodiment of the apparatus of the present invention is illustrated as including a die member 10 defining a longitudinally extending die cavity 12, the latter having a transverse cross-section which continuously decreases towards the downstream or right (as seen in FIG. 1) end thereof. Referring to FIGS. *2a–2c*, the die cavity 12 has a downstream end region 14 (FIG. *2c*) having a substantially circular reduced cross-section which extends from the plane of the cavity outlet for limited axial extent inwardly. The die cavity 12 has a mid-region 16 formed upstream of end region 14 which has a non-circular cross section (FIG. *2b*). Thus, referring to FIG. *2b*, the non-circular cross-section of mid-region 16 may have any appropriate non-circular cross-section such, for example, as a substantially oval shape or, alternatively, may be defined by two pairs of opposed walls 16*a*, 16*b*, each pair having the configuration of a segment of a circle. Finally, the die cavity 12 has an upstream end region 18 (FIG. *2a*) having a substantially circular cross-section which extends from the plane of the cavity inlet inwardly to the plane where the non-circular mid-region begins.

The die member 10 is mounted for positive rotation about its longitudinal axis 20. By "positive rotation" is meant a rotation effected by external means as opposed to a free rotation resulting solely from the passage of the deforming material through the cavity which might occur, for example, in the manufacture of a helixed wire. Thus, die member 10 is provided with a circumferentially extending worm wheel 22 adapted to cooperate with a worm 24. Thus, rotation of the worm 24 via a suitable motor (not shown) will cause the die member 10 to rotate about its longitudinal axis 20.

In operation, the material to be deformed which is illustrated in the form of a billet 26 is introduced into the inlet end of the die cavity 12. The billet 26 is forced under compression or tension through the die cavity. Thus, the billet may be compressed by a cylinder or under fluid pressure, illustrated schematically at 28 as is well known in which case the metal will be under compression or, alternatively or additionally, may be pulled through the cavity by conventional rollers, illustrated schematically at 30, situated externally of the cavity outlet. According to the present invention, as the billet 26 moves longitudinally within the die cavity 12, the worm is actuated whereby the die member 10 is rotated. By virtue of the non-circular configuration of mid-region 16 of die cavity 12, a rotational torque is imparted to the billet 26.

At the same time, a rotation resisting torque is transmitted to the billet so that the latter remains angularly stationary although it continues to move longitudinally within the cavity 22. Thus, a pair of grooved friction wheels 32*a*, 32*b* are located over the billet 26 upstream of die member 10 which serve to impart a resisting torque to the billet while allowing the downstream longitudinal movement thereof.

In this manner, a torque is imparted to the deforming material as it passes through the die cavity. This torque produces shear stresses within the material which facilitate a reduction in the circular cross-section of the material as it moves through the cavity. Thus, it is possible utilizing the method and apparatus of the present invention for the diameter of the circular cross-section of the downstream end region 14 of the die to be less than what otherwise be possible were no torque to be imparted to the material, as is conventional. Another advantage incidental to the use of the method and apparatus of the present invention is that the lubrication of the interface between the die cavity and the material flowing through it it is improved by virtue of the rotation of the die member.

It should also be apparent that a torque can be imparted to the material as it moves longitudinally through the die cavity by maintaining the die member stationary while rotating the billet 26 around its longitudinal axis. Thus, the billet 26 will be rotated by means, schematically illustrated at 34, and which may, for example, comprise suitably adapted belts or friction wheels. The worm 24 will remain inactivated so that the die member 10 will not rotate. In this manner, a torque is imparted to the billet 26 within the cavity 12 through the non-circular mid-region 16 thereof. Thus, the reduction of the cross-section of the material as it passes longitudinally through the die cavity will be facilitated in the same manner as in the case where the die member is rotated and the billet held rotatably stationary.

Figure 3:
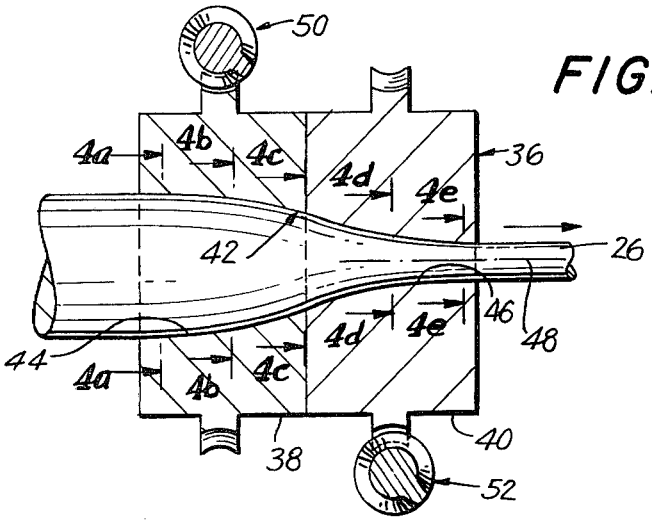
FIG. 3 is a schematic view of another embodiment of the apparatus of the present invention, illustrating the method of the present invention.
Figure 4A:
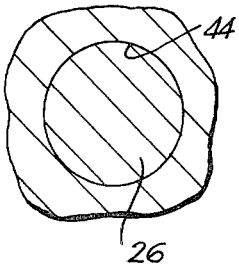
FIGS. 4*a*–4*e* are section views taken along corresponding lines through FIG. 3.
Figure 4B:
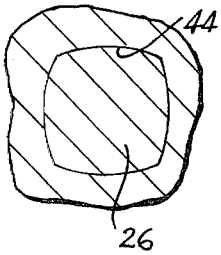
Figure 4C:
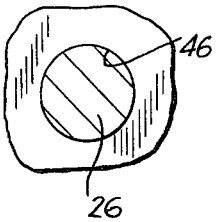
Figure 4D:
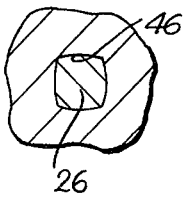
Figure 4E:
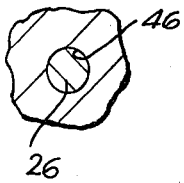

Referring now to FIGS. 3 and 4, another embodiment of an apparatus constructed according to the present invention is illustrated. In this embodiment, the die apparatus comprises a split die member 36 which functions to impart the resisting torque to the billet 26 without the necessity for external equipment such as the belts or friction wheels, discussed above. Thus, the split die member 36 comprises an upstream die member 38 and a downstream die member 40, the outlet of upstream die member 38 being contiguous with the inlet of downstream die member 40 and wherein a continuous die cavity 42 extends from the inlet of the upstream die member to the outlet of the downstream die member. Of course, the die cavity 42 is defined by upstream and downstream cavity halves 44, 46. As seen in FIGS. *4a–4e*, each respective cavity half includes upstream and downstream end regions having circular cross-sections and mid-regions having non-circular cross-sections.

The upstream and downstream die members 38, 40 are suitably mounted so that each is rotatable about the longitudinal axis 48 defined by the die cavity 42 with respect to each other. Thus, an interfitting collar and groove structure (not shown) may be provided on the contiguous end surfaces of the respective die members to allow for relative rotation of the respective die members.

In operation, the material to be deformed which may comprise a billet 26 similar to that shown in FIG. 1, is introduced into the inlet end of the upstream cavity half 44 and forced under compression or tension through the die cavity 42 so as to exit through the outlet end of cavity half 46. As the billet 26 moves through cavity 42, one of the die members 38, 40 is rotated about axis 48. Thus, for example, the upstream die member 38 may be rotated through the mechanism of a worm assembly 50 while the downstream die member 40 is prevented from rotating by suitably fixing the corresponding worm assembly 52. In this manner, a torque is imparted to the deforming material by virtue of the rotation of die member 38 and its non-circular mid-region. A resisting torque is provided by the fixation of downstream die member 40 and its non-circular mid-region.

Figure 5:
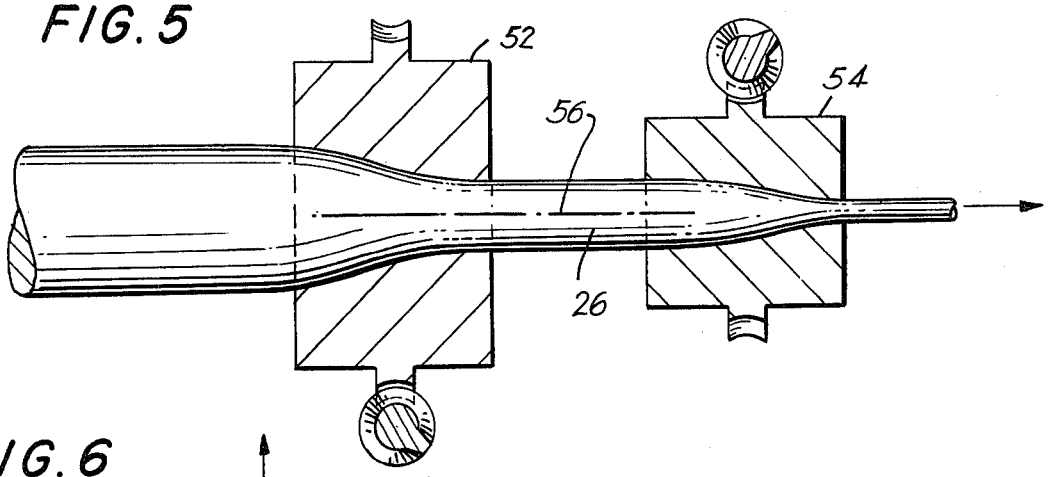
FIG. 5 is a schematic view of yet another embodiment of the apparatus of the present invention illustrating the method of the present invention.

Referring now to FIG. 5, another embodiment of an apparatus constructed according to the present invention is illustrated. This embodiment is similar to that described in connection with FIGS. 3 and 4 in that an upstream die member 52 and a downstream die member 54 are utilized. However, upstream and downstream die members 52, 54 are not connected but, rather, are spaced from each other as shown in FIG. 5. Again, each of the cavities defined in the respective die members is formed having upstream and downstream end regions having circular cross-sections and a mid-region having a non-circular cross-section. The cross-section of the outlet of the cavity of the upstream die member 52 is substantially identical to the cross-section of the inlet of the cavity of the downstream die member 54. Both of the die members 52, 54 may be provided with appropriate means for rotating the same about the longitudinal axis 56 defined by the aligned cavities formed therein. In operation, the material to be deformed is forced through the successive cavities while one of the die members is rotated and the other preferably held stationary. In this manner, a torque is imparted to the material by the rotating die member and a resisting torque is provided by the non-rotating die member. The reduction in the diameter of the cross-section of the material is, in this way, facilitated.

Figure 6:
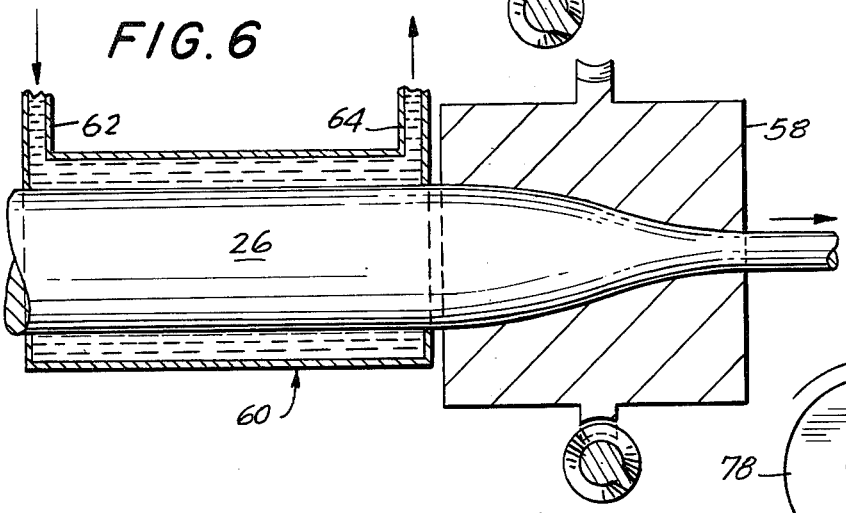
FIG. 6 is a schematic view of yet another embodiment of the present invention illustrating the method thereof.

Referring now to FIG. 6, yet another embodiment of the present invention is illustrated wherein a die member 58 having essentially the same construction as that shown in FIGS. 1 and 2 is provided. In this embodiment, the resisting torque is applied to the billet 26 through the application of hydrostatic viscous forces. More particularly, a cylindrical sleeve 60 envelopes an axial portion of billet 26, the sleeve 60 having a fluid inlet opening 62 and a corresponding outlet opening 64. Thus, as torque is imparted to the deforming material through rotation of die member 58, a resisting torque is provided through the application of the viscous forces of a fluid which is directed to flow through sleeve 60 in contact with the outer surface of billet 26. Although it has been found that the magnitude of the shear stresses produced using this arrangement is somewhat less than the shear stresses produced using a split die apparatus or the like which positively or mechanically produces a resisting torque, the use of the embodiment of FIG. 6 has been found sufficient to produce shear stresses which are effective in facilitating the reduction of the diameter of the circular cross-section of the material.

Figure 7:
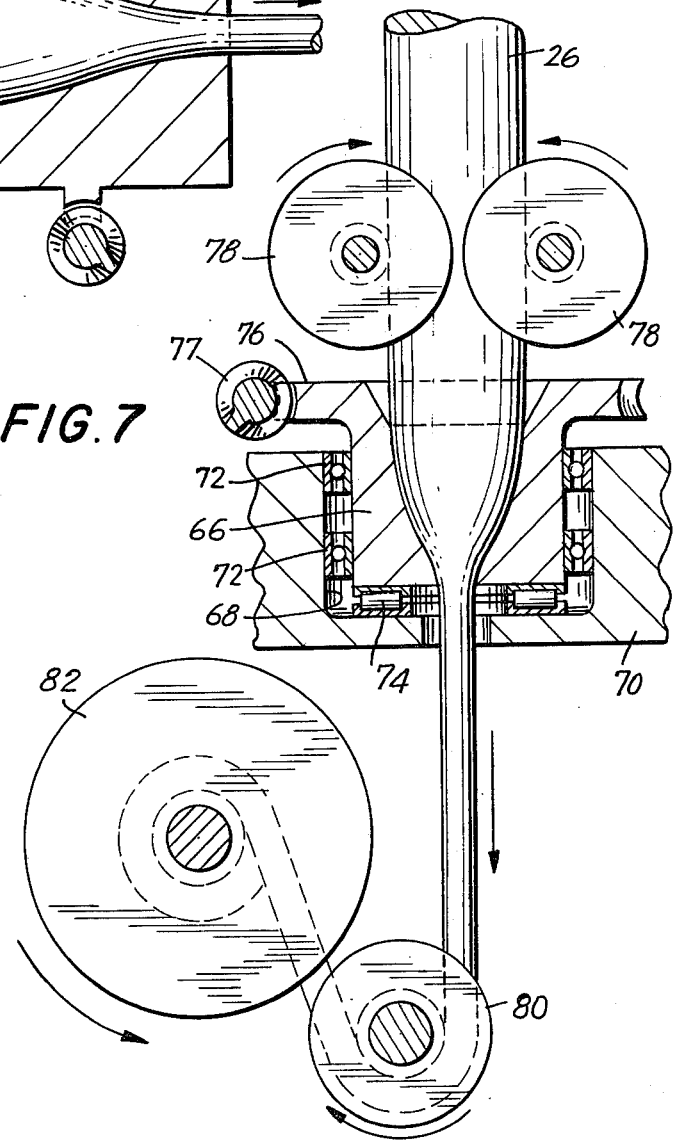
FIG. 7 is an assembly view of the apparatus of the present invention.

Referring now to FIG. 7, an arrangement constructed according to the present invention for manufacturing wire having circular cross-section is illustrated. Thus, a die member 66 is rotatably mounted within a recess 68 formed in a wall 70. The die member 66 is rotatably mounted by a pair of roller bearings 72 while a thrust bearing 74 is provided to accommodate the axial load exerted on the die member 66 during operation. Die member 66 defines a cavity preferably having substantially the same configuration as that described in connection with FIGS. 1 and 2. The upstream end of die member 66 has an outwardly extending flange 76 which may comprise a sprocket wheel or the like which is operatively connected to a rotatable drive mechanism 77. A pair of grooved feed rolls 78 cooperate with each other to force the billet 26 through the die cavity while the latter rotates. The produced wire exiting from the outlet of the die member 66 passes around an idler roller 80 and it is ultimately wound on a takeup spool 82. The feed rolls 78 provide the resisting torque to the material. Further, the idler may contribute, if necessary, additional resisting torque. Thus it is seen that a continuous operation whereby the cross-sectional diameter of material may be reduced utilizing torsional as well as compressive and/or tension forces is provided.

The method and apparatus of the present invention may also be utilized in connection with the manufacture of tubular members, such as pipe and the like. Various apparatus for manufacturing tubular members according to the present invention are illustrated in FIGS. 8–10.

Figure 8:
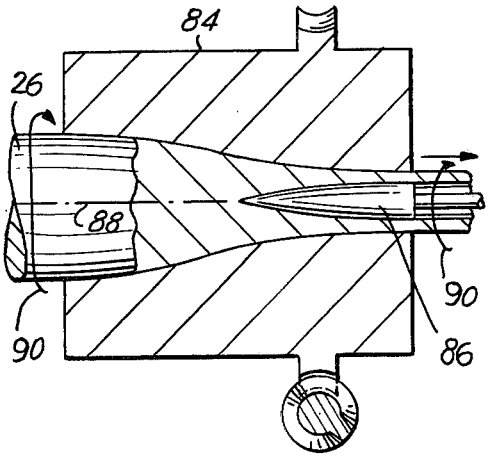
FIG. 8 is a schematic view of an apparatus according to the present invention for forming tubular articles, illustrating the method thereof.

Referring to FIG. 8, a rotatable die member 84 defining a cavity having the same configuration as the die member illustrated in FIGS. 1 and 2 is provided. An elongate mandrel 86 having a substantially conical configuration is located within the die cavity and extends substantially along the longitudinal axis 88 defined by the die cavity. In operation, the billet 26 is forced through the die cavity under tension and/or compression while the die member 84 is positively rotated thereby imparting a torque to the deforming material. A resisting torque is provided to the billet or the formed tube or both by suitable means, described above, and schematically illustrated by arrows 90. In this manner, a tubular member having a reduced outer diameter is formed.

As in the case of the manufacture of elongated solid articles, either the die or the billet may be positively rotated to impart a torque to the deforming material. Thus, should the billet be rotated, the die will remain rotatably stationary and will thereby impart the resisting torque to the material. Further, it should be noted that it is possible to employ an arrangement whereby the billet is held axially stationary with the die being fed over the billet in an axial direction.

Referring to FIG. 9, another embodiment of the apparatus of the present invention for manufacturing tubular members is illustrated. Thus, a die member 92 is provided defining a cavity 94 which may have one of two possible configurations. In a first configuration, the cavity 94 has a substantially conical configuration, that is, the cross-section of cavity 94 is substantially circular throughout its entire axial extent. A mandrel 96 is located within cavity 94 in a manner similar to that described above in connection with FIG. 8. However, the mandrel 96 is formed having an upstream end region 98 and a downstream end region 100 which are substantially circular in cross-section and further includes a mid-region 102 which is non-circular in cross-section. In the operation of this particular configuration of FIG. 9, as the billet 26 is forced through die cavity 94, the mandrel is rotated (arrow 103) while the die member 92 is fixed. A resisting torque is provided on the deforming material by suitable means, schematically illustrated by arrows 108. In this manner, a torque is applied to the material through the rotation of the mandrel 96 to facilitate the reduction in the cross-sectional diameter of the deforming material. Of course, as is the case in the above-described embodiments, the mandrel 96 may be held stationary while the billet 26 is rotated. In this case, the resisting torque will be supplied by the mandrel 96.

In the other configuration of FIG. 9, the die cavity 94 is formed having a configuration substantially the same as that described above in connection with FIGS. 1 and 2. In this configuration, either the die member 92 or the mandrel 96 may rotate to impart a torque to the material. Thus, for example, die member 92 is positively rotated by suitable means described above while the mandrel is held stationary. Thus, the die 92 will impart a torque to the material while the mandrel 96 provides a resisting torque therefore.

Referring to FIG. 10, another embodiment of an apparatus for manufacturing a tubular member is illustrated wherein a split die member 104, substantially identical to the split die member 36 described above in connection with FIGS. 3 and 4, is utilized. A substantially conical mandrel 106 extends along the longitudinal axis of the split die member 104 at least through the downstream die member thereof. Thus, as the billet 26 is forced through the die cavity defined by the split die member 104, one of the die members 109, 110 is rotated while the other one of the die members is maintained rotatably stationary. Thus, in this embodiment, a torque is supplied to the deforming material by the rotating die member while a resisting torque is supplied by the non-rotating die member.

Turning now to FIG. 11, yet another embodiment of the present invention for manufacturing tubular members is illustrated. This embodiment differs from those described above in that the die cavity 112 is substantially cylindrical and in the illustrated embodiment is closed at one end thereof. Thus, a container 114 defining the cylindrical die cavity 112 is fixed in place. A mandrel 116 having a mid-region having a non-circular cross-section, i.e., having substantially the same configuration as the mandrel discussed above in connection with FIG. 9, is axially movably mounted substantially along the longitudinal axis 118 defined by die cavity 112. The billet is placed within die cavity 112 and the mandrel 116 is axially moved into the die cavity in the direction of arrow 120 while simultaneously rotating about its longitudinal axis as indicated by arrow 122. Thus, a torque is imparted to the material by virtue of the rotating mandrel 116. The friction between the billet and the container walls provides a resisting torque to the material. In this embodiment, although the cross-sectional diameter of a billet is not being reduced, the principles of the present invention are utilized in that the formation of the tubular member which, of course, is extruded from the open end of the die cavity 112 is facilitated relative to methods and apparatus wherein the mandrel was merely axially moved into the die cavity with no rotational torque being applied to the material contained therewithin.

It should be noted that the method and apparatus illustrated in FIG. 11 may be practiced utilizing a container which is open at both of its ends. In this case, a longitudinal thrust is required to be imparted to the billet at the end of the container opposite from the end from which the billet is extruded and in a direction opposite to the direction of movement of the mandrel. This embodiment has the further advantage that a positive resisting torque can be applied to the billet on a portion thereof which extends from the open end of the container.

Referring now to FIGS. 12 and 13, forging apparatus are illustrated which utilize the principles of the present invention. Thus, referring to FIG. 12, a pair of die members 124, 126 of the closed type, i.e., having only one open end, are provided whose respective die cavities 128, 130, are in spaced, axially aligned relationship to each other. Each die cavity is formed having upper and lower end regions having substantially circular cross-sections and a mid-region having a non-circular cross-section, as clearly shown in FIGS. 12*a*–12*c*. At least one of the die members is provided with means for positively rotating the same about its longitudinal axis. Such means may take the form of the worm and worm wheel apparatus described above. In operation, a billet 132 is appropriately located in the space between the die members 124, 126 and a forging load is applied to the respective die members to urge the same towards each other. At the same time, at least one of the die members is rotated about the longitudinal axis whereby a torque is imparted to the deforming material by virtue of the region of the respective die cavity having a non-circular cross-section. Thus, in the same manner as in the case of the previously described embodiments, the billet is deformed by an axial load and by torsion.

Referring to FIG. 13, a forging apparatus especially designed for the manufacture of flanged shafts is illustrated. A pair of open die members 134, 136 are located in spaced, axially aligned relationship to each other. The die members 134, 136 define respective die cavities 138, 140 having substantially the same configuration as the die cavity described above in connection with FIGS. 1 and 2, that is, include a mid-region having a non-circular cross-section. The die members 134, 136 are provided with means for positively rotating the same. A metal billet 142 having an orginal, substantially rectangular configuration is located between the spaced die members whereupon axial compressive force is applied so as to urge the die members towards each other. Simultaneously, at least one of the die members is rotated about its longitudinal axis to impart a torque to the deforming material. In this manner, the deforming material flows through the outlet ends of the respective die cavities while a flange portion 144 extrudes radially outwardly between the respective die members.

Figure 14:
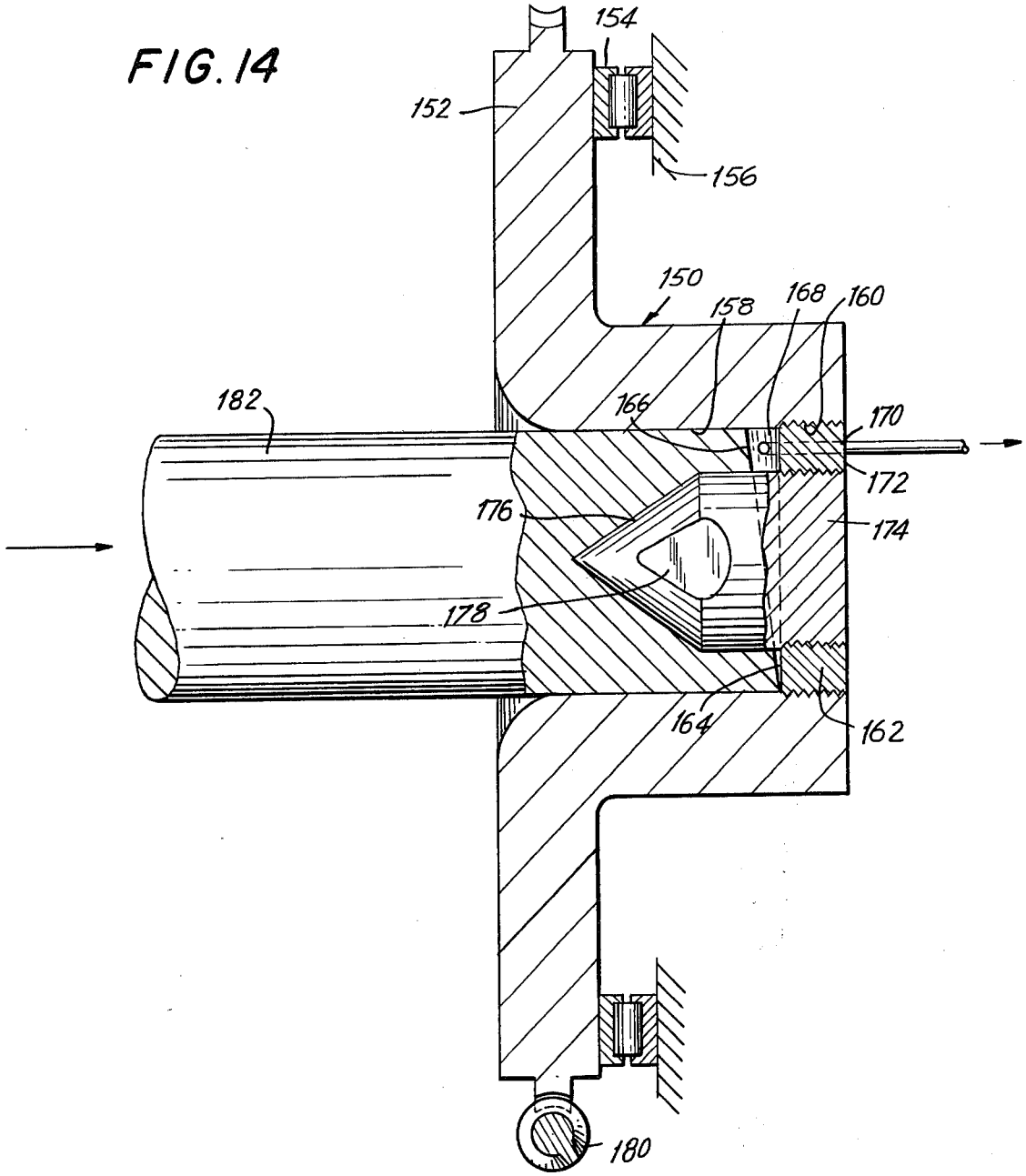
FIG. 14 is a schematic view in section of an embodiment of the present invention for use in manufacturing wire.

Referring now to FIG. 14, an embodiment of the present invention adapted for use in the manufacture of wire is illustrated. The wire manufacturing apparatus includes a die member 150 having an outwardly directed flange portion 152 mounted by thrust bearings 154 on a frame 156. a cylindrical die cavity 158 is defined within die member 150, a downstream end portion thereof having screw threads 160 formed in the surface thereof. An annular cutter member 162 is threadedly fixed in the downstream end portion of die cavity 158 having an inner surface 164 on which a cutting edge 166 is defined by an obliquely extending surface 168 formed thereon. A bore 170 is formed in cutter member 162 which opens at its ends onto surface 168 and the outer surface 172 of cutter member 162. A piercer member 174 is axially disposed within die cavity 158 and fixed therein by means of a threaded connection to cutter member 162 as illustrated. Piercer member 174 has an inwardly tapered portion 176 and is formed having a non-circular cross-section defined by a flat 178 which extends along at least a portion of the axial extent thereof. Conventional apparatus 180 for rotating the die assembly, including die member 150, the cutter member 162 and the piercer member 174 are provided.

In operation, a billet 182 is fed into the upstream end of die cavity 158 with the aforementioned die assembly rotating. Thus, the billet is initially pierced by the tip of piercer member 176 and a rotary torque is imparted thereto upon the billet flowing over the non-circular portion of the piercer member 174. A resisting torque is applied to the billet upstream from and externally of die cavity 158. Upon encountering the inner surface 164 of cutter member 162, the material is cut and extruded through the bore 170. It should be noted that alternatively the die assembly may be held rotatably stationary with the billet being rotated about the longitudinal axis.

The method and arrangement described above are advantageous in that in conventional arrangements, such, for example as the "Hydrospin" method, it is not possible to accomplish the piercing of the billet without applying a relatively large axial thrust to the billet which is greater than the yield stress of the metal. The present invention is advantageous in that a portion of the work required to deform the billet is supplied through the torque supplied as described above thereby requiring an axial thrust of significantly lesser magnitude. It should also be noted that alternatively the die assembly may be held rotatably stationary with the billet being rotated.

In all of the embodiments of the invention described above, it is readily understood that the essential principle being applied is that during the deformation of the material, in addition to the axial (compressive or tensile) load being utilized to deform the material, a torsional load is additionally employed. The torsional load sets up shear stresses in the material which facilitates the extrusion thereof in that additional work is being exerted to reduce the cross-sectional diameter of the material being deformed.

Obviously, numerous modifications and variation of the present invention are possible in the light of the above teachings. It is therefore to be understood that within the scope of the appended claims the invention may be practiced otherwise than as specifically described herein.

What is claimd is:

1. A method for forming an elongated article having a reduced diameter circular cross-section comprising the steps of: introducing material into a longitudinally extending cavity of a die apparatus, said cavity being open only at its transverse inlet and outlet ends and closed along its entire longitudinal extent and being defined by an upstream end region having a substantially circular cross-section, a downstream end region having a reduced diameter substantially circular cross-section and a region longitudinally upstream of the downstream end region having a non-circular cross section; and moving the material longitudinally through the die cavity under tension or compression while simultaneously rotating one of the die apparatus and material around the longitudinal axis of the cavity while imparting a resisting torque to the other of the die apparatus and material to deform the material within the die cavity around the longitudinal axis thereof simultaneously with the material moving longitudinally through the die cavity to facilitate a reduction in circular cross-section therein as the material moves through the cavity.

2. The method as recited in claim 1 wherein said step of deforming the material within the cavity around the axis thereof includes rotating the die apparatus about its longitudinal axis with respect to the material contained and moving longitudinally within the cavity thereof, and simultaneously imparting a resisting torque to the material.

3. The method as recited in claim 1 wherein said step of deforming the material within the cavity around the axis thereof includes rotating the material about its longitudinal axis within the die cavity and simultaneously applying a resisting torque to the die apparatus.

4. The method as recited in claim 1 wherein said die apparatus comprises upstream and downstream die members having axially aligned cavities, each cavity having a downstream end region having a substantially circular cross-section, a region longitudinally upstream of the respective downstream region thereof having a non-circular cross-section, and an upstream end region having a substantially circular cross-section, and wherein the step of deforming the material includes rotating one of the die members about its longitudinal axis with respect to the material contained and moving longitudinally within the cavity thereof while said other of said die members remains stationary, thereby applying a resisting torque to the material.

5. The method as recited in claim 4 further including the step of locating the inlet of the downstream die cavity contiguous with the outlet of the upstream die cavity so that the upstream and downstream die members comprise a split die member.

6. The method as recited in claim 1 wherein said upstream and downstream die members are located in tandem in spaced relation to each other.

7. The method as recited in claim 1 wherein said elongated article comprises a tubular article and further including the step of locating an elongate mandrel within the die cavity with the longitudinal axis of the mandrel substantially colinear with the longitudinal axis of the die cavity.

8. The method of claim 7 wherein the die apparatus comprises upstream and downstream die members having aligned die cavities comprising a split die member, the inlet of the downstream die cavity being contiguous with the outlet of the upstream die cavity and the mandrel extending at least within the downstream die cavity and wherein the step of imparting a torque to the material includes rotating one of the die members about its longitudinal axis while the other of said die members remains stationary, thereby applying a resisting torque to the material.

9. The method as recited in claim 7 wherein a region of the die cavity longitudinally upstream of the downstream end region has a non-circular cross-section.

10. The method as recited in claim 9 wherein the step of imparting a torque to the material includes rotating the die apparatus about its longitudinal axis with respect to the material contained and moving longitudinally within the cavity thereof and simultaneously imparting a resisting torque to the material.

11. The method as recited in claim 9 wherein the step of imparting a torque to the material includes rotating the material about its longitudinal axis within the die cavity and simultaneously applying a resisting torque to the die member.

12. The method as recited in claim 9 wherein the mandrel is formed with an axial portion having a non-circular cross-section and wherein the step of imparting a torque to the material includes rotating the mandrel about its longitudinal axis.

13. Apparatus for forming an elongated article having a reduced diameter circular-cross-section comprising: die apparatus having a longitudinally extending die cavity being open only at its transverse inlet and outlet ends and closed along its entire longitudinal extent and being defined by an upstream end region having a substantially circular cross-section, a downstream end region which has a reduced diameter substantially circular cross-section and a region longitudinally upstream of the downstream end region which has a non-circular cross-section; means for moving the material from which the article is made in the longitudinal direction through the die cavity; means for deforming the material within the die cavity around the longitudinal axis thereof comprising means for rotating one of the die apparatus and material around the longitudinal axis of the die cavity while imparting a resisting torque to the other of the die apparatus and material while the material moves longitudinally through the die cavity so that the material is twistingly deformed within the die cavity around the longitudinal axis thereof while being subjected to compression within the cavity to facilitate a reduction in circular cross-section therein as the material moves through the cavity.

14. Apparatus as recited in claim 13 wherein said means for deforming the material within the die cavity around the longitudinal axis thereof comprises means for rotating the die apparatus about the longitudinal axis of the die cavity while imparting a resisting torque to the material.

15. Apparatus as recited in claim 13 wherein said die apparatus comprises upstream and downstream die members having axially aligned cavities, each cavity having a downstream end region having a substantially circular cross-section, a region longitudinally upstream of the respective downstream region thereof having a non-circular cross-section, and an upstream end region having a substantially circular cross-section, and wherein said means for deforming the material within the die cavity around the longitudinal axis thereof includes means for rotating one of the die members with respect to the other of said die members.

16. Apparatus as recited in claim 15 wherein said upstream and downstream die members are located in tandem and spaced relation to each other.

17. Apparatus as recited in claim 15 wherein the upstream and downstream die members comprise a split die member, the substantially circular inlet of the downstream die cavity being contiguous with the substantially circular outlet of the upstream die cavity.

18. Apparatus as recited in claim 13 wherein said elongated article comprises a tubular article, further including an elongate mandrel located within the die cavity with the longitudinal axis of the mandrel substantially colinear with the longitudinal axis of the die cavity.

19. Apparatus as recited in claim 18 wherein said torque imparting means comprises a region of the die cavity longitudinally upstream of the downstream end region which has a non-circular cross-section.

20. Apparatus as recited in claim 19 wherein the mandrel is formed with an axial portion having a non-circular cross-section and means for rotating said die member and/or said mandrel about their respective longitudinal axes as said material moves through said die cavity.

21. Apparatus as recited in claim 18 wherein said die apparatus comprises upstream and downstream die members having axially aligned cavities, each having a downstream end region having a substantially circular cross-section and regions upstream therefrom having a non-circular cross-section and wherein said mandrel extends within and along the longitudinal axis of at least the cavity of the downstream die member.

22. Apparatus as recited in claim 21 wherein said upstream and downstream die members are located in tandem and spaced relation to each other.

23. Apparatus as recited in claim 21 wherein said upstream and downstream die members comprise a split die member, the inlet of the downstream die cavity being contiguous with the outlet of the upstream die cavity.

24. Apparatus as recited in claim 21 wherein said mandrel has an axial portion having a non-circular cross-section and wherein said torque imparting means includes means for rotating at least one of said die members and mandrel about its respective longitudinal axis, the other of said die members and mandrel applying a resisting torque to the material.

25. Apparatus as recited in claim 13 wherein said means for deforming the material within the die cavity around the longitudinal axis thereof comprises means for rotating the material about the longitudinal axis of the die cavity while imparting a resisting torque to the die apparatus.

* * * * *